US005803191A

United States Patent [19]

Mackintosh

[11] Patent Number: 5,803,191

[45] Date of Patent: Sep. 8, 1998

[54] WELL ENTRY TOOL

[76] Inventor: Kenneth Mackintosh, Verners Hall, Drumtochty, Auchenblae, Laurencekirk, Kincardineshire AB30 1TQ, United Kingdom

[21] Appl. No.: 737,956

[22] PCT Filed: May 26, 1995

[86] PCT No.: PCT/GB95/01209

§ 371 Date: Nov. 27, 1996

§ 102(e) Date: Nov. 27, 1996

[87] PCT Pub. No.: WO95/33120

PCT Pub. Date: Dec. 7, 1995

[30] Foreign Application Priority Data

| | | | |
|---|---|---|---|
| May 28, 1994 | [GB] | United Kingdom | 9410801 |
| Jul. 2, 1994 | [GB] | United Kingdom | 9413340 |
| Sep. 9, 1994 | [GB] | United Kingdom | 9418188 |

[51] Int. Cl.[6] ..... F21B 19/08; F21B 33/072

[52] U.S. Cl. ..... 175/170; 166/77.1; 166/242.5

[58] Field of Search ..... 175/195, 220, 175/257, 170, 320; 166/77.1, 242.5, 385

[56] References Cited

U.S. PATENT DOCUMENTS

| | | | |
|---|---|---|---|
| 1,509,906 | 9/1924 | Sawtelle | 184/15.1 |
| 2,815,969 | 12/1957 | Lebourg | 277/322 |
| 4,681,162 | 7/1987 | Boyd | 166/242.5 |
| 5,284,210 | 2/1994 | Helms et al. | 166/385 |

FOREIGN PATENT DOCUMENTS

| | | | |
|---|---|---|---|
| 411260 | 6/1991 | European Pat. Off. . | |
| 1240886 | 6/1986 | U.S.S.R. | 175/170 |

*Primary Examiner*—David J. Bagnell
*Attorney, Agent, or Firm*—Ratner & Prestia

[57] ABSTRACT

A well entry tool includes an upper tubular member (10) and a lower tubular member (14) connected together by an intermediate assembly. The upper and lower tubular members (10, 14) are provided with outer end portions (12, 16) for connection of the tool in a drill string for fluid flow through the tool. The intermediate assembly includes a hollow body (18) which includes aligned, spaced bearings (30) receiving the upper and lower tubular members (10, 14) to provide rotation of the tubular members (10, 14) relative to the hollow body (18). A power transmission device is provided within the hollow body (18) for transmitting torque from the upper tubular member (10) to the lower tubular member (14) and an entry device (42) permits a wire or similar flexible member to pass sealingly from the exterior to the interior of the hollow body (18).

17 Claims, 5 Drawing Sheets

WELL ENTRY TOOL

This invention relates to well or borehole drilling equipment having means for handling wireline equipment and similar flexible elongate equipment which may be inserted into a well or borehole.

The use of wireline instruments for well inspection and logging is well known. Conventionally, however, the use of wireline instruments necessitates the removal of the derrick mud hose to permit entry of the wireline. This has the result that drilling mud cannot be circulated during use of the wireline, with consequent risk of well blow-out. There is also the consequence that the mud pump cannot be used to drive the wireline tool through the well bore, which would be desirable for example in highly deviated wells.

There are also problems in the conventional method of feeding wireline into the drill string through the top drive motor housing, since this involves passing the wire through a tight angle which interferes with ready feeding of the wire.

Accordingly, the invention provides a well entry tool comprising an upper tubular member and a lower tubular member connected together by an intermediate assembly; the upper and lower tubular members being provided with outer end portions for connection of the tool in a drill string for fluid flow therethrough; the intermediate assembly comprising a hollow body including axially aligned, spaced bearing devices receiving the upper and lower tubular members to provide rotation of the tubular members relative to the hollow body, a power transmission mechanism within the hollow body for transmitting torque from the upper tubular member to the lower tubular member, and an entry device allowing a flexible elongate member to pass sealingly from the exterior to the interior of the hollow body.

The elongate member may be a wireline, coil tubing or any other flexible elongate member which it is desired to insert into a borehole or well.

Preferably, the hollow body comprises a tubular outer housing and a pair of end plates.

The bearing means may be mounted in the end plates.

The power transmission mechanism suitably comprises respective annular cogs secured to the inner ends of the tubular members and interconnected by means of meshing cogs mounted on one or more layshafts.

Preferably, three layshafts are used, which are equispaced circumferentially of the tool. The layshafts may conveniently be rotatably mounted on the end plates.

In an alternative arrangement, each layshaft is associated with an intermediate layshaft providing an additional cog, whereby the upper and lower tubular members rotate in opposite directions.

The entry device preferably comprises a passage through the upper end plate aligned at an acute angle to the bore of the lower tubular member. Typically, the acute angle is a shallow angle. Preferably, the tool is used for wireline and the entry means forms a wireline entry means. Said passage may be provided by a grease tube threadedly secured in an angled bore in the upper end plate. The grease tube is preferably provided at its outer end with a pack-off.

The grease tube may optionally be contained within an outer tubular member for additional strength and safety. The wireline will typically enter the outer tubular member via a stuffing box.

The outer housing is preferably securable to a tie rod assembly adapted for fixing, for example, to the bail arms of a drill rig.

The invention, from another aspect, also provides a grease tube for use in the foregoing tool, the grease tube comprising two longitudinal tube halves releasably secured together to define a bore for passage of a wire. The tube halves may be secured together by interengageable lugs and slots, which preferably exert a wedging force. Preferably, the tube halves are provided with external formations which, when the tube halves are secured together, form means (for example a screw thread) for securing the grease tube to a wireline entry tool as defined above.

The grease tube may further be provided with an outer tubular member, which may be provided at one end with a stuffing box.

An advantage of the invention is that it permits a well entry tool, for example for wireline entry, to be incorporated into a drill sting to allow wireline access to the drill string and to permit rotation of the drill string with the tool under pressure conditions while sealing on the wireline.

Embodiments of the invention will now be described, by way of example only, with reference to the drawings, in which.

Figure 1:
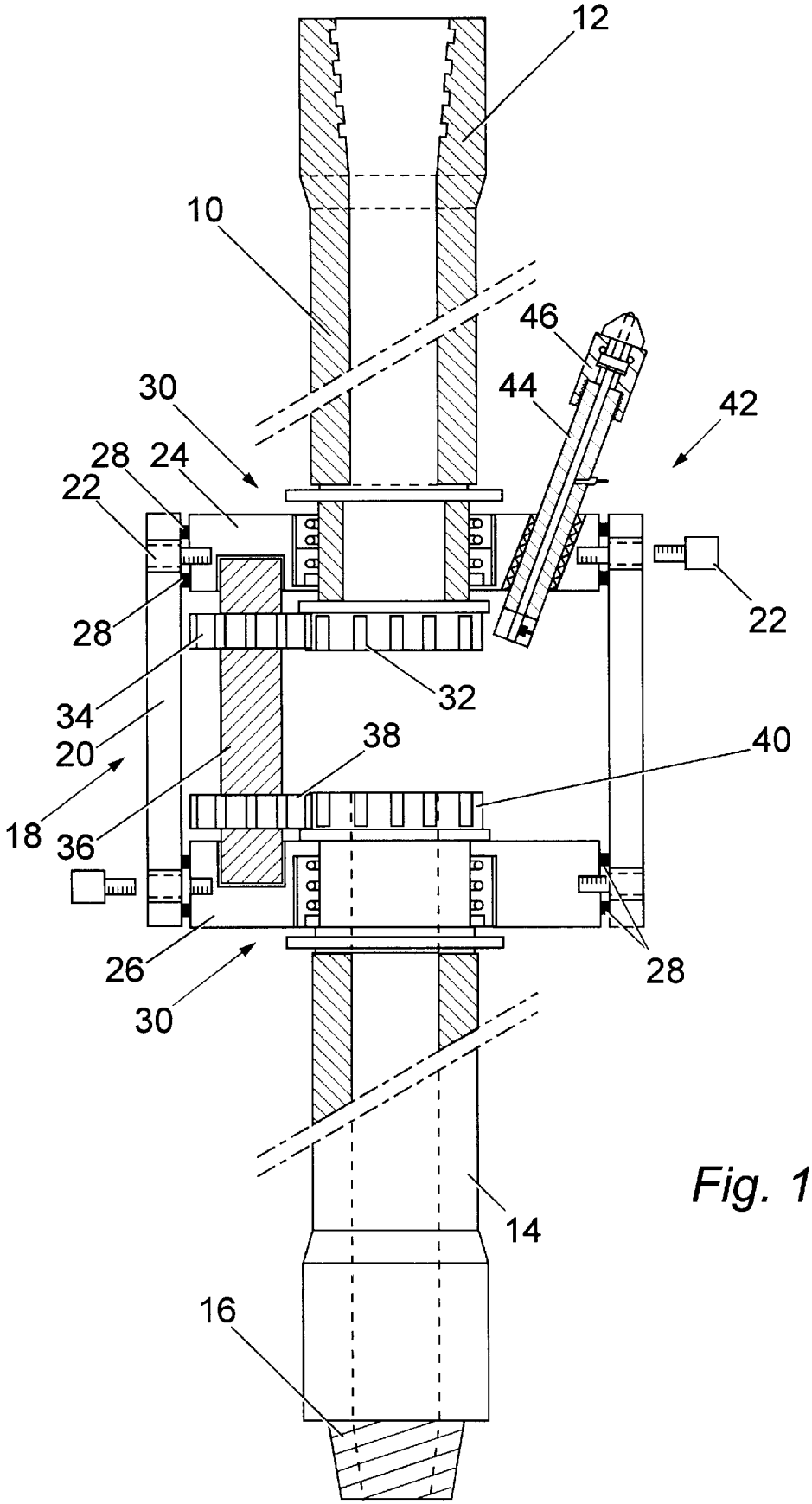
FIG. 1 is a sectional side view of one form of wireline entry tool in accordance with the invention.

Referring to FIG. 1, a wireline entry tool comprises an upper tubular sub 10 having a box connector 12, and a lower tubular sub 14 having a pin connector 16, whereby the tool can be connected in a conventional drill string. The upper sub 10 and lower sub 14 are interconnected by a torque transmitting wireline entry assembly generally designated at 18. The assembly 18 remains rotationally stationary during rotation of the drill string while at the same time transmitting torque from the drill string above it to the drill string below it and vice versa.

The assembly 18 comprises a cylindrical outer housing 20 secured by cap screws 22 to upper and lower end plates 24 and 26. O-ring seals 28 are provided between the outer housing 20 and the end plates 24, 26 to seal the assembly 18. The upper and lower subs 10 and 14 are each provided with a bearing and seal assembly generally designated at 30, which has the function of mounting the sub 10 or 14 for relative rotation in the respective end plate 24 or 26.

Figure 4:
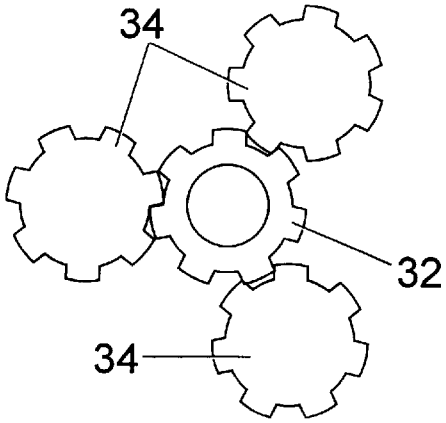
FIG. 4 is a schematic plan view showing the disposition of a cog system in the apparatus of FIG. 1.

The lower end of the upper sub 10 has secured to it an annular cog 32 which meshes with three equispaced cogs 34 (see FIG. 4) secured on axial layshafts 36 which are mounted for rotation in the end plates 24, 26. An equivalent system, comprising cogs 38 on the layshafts 36 in mesh with an annular cog 40 secured to the upper end of the lower sub 14, transmits drive to the latter.

In the preferred arrangement shown, a 1:1 drive is obtained using cogs all of equal size. A 1:1 drive would normally be desired to cause the drill string to rotate in its usual manner, and other transmission arrangements for achieving this will be apparent.

Figure 2:
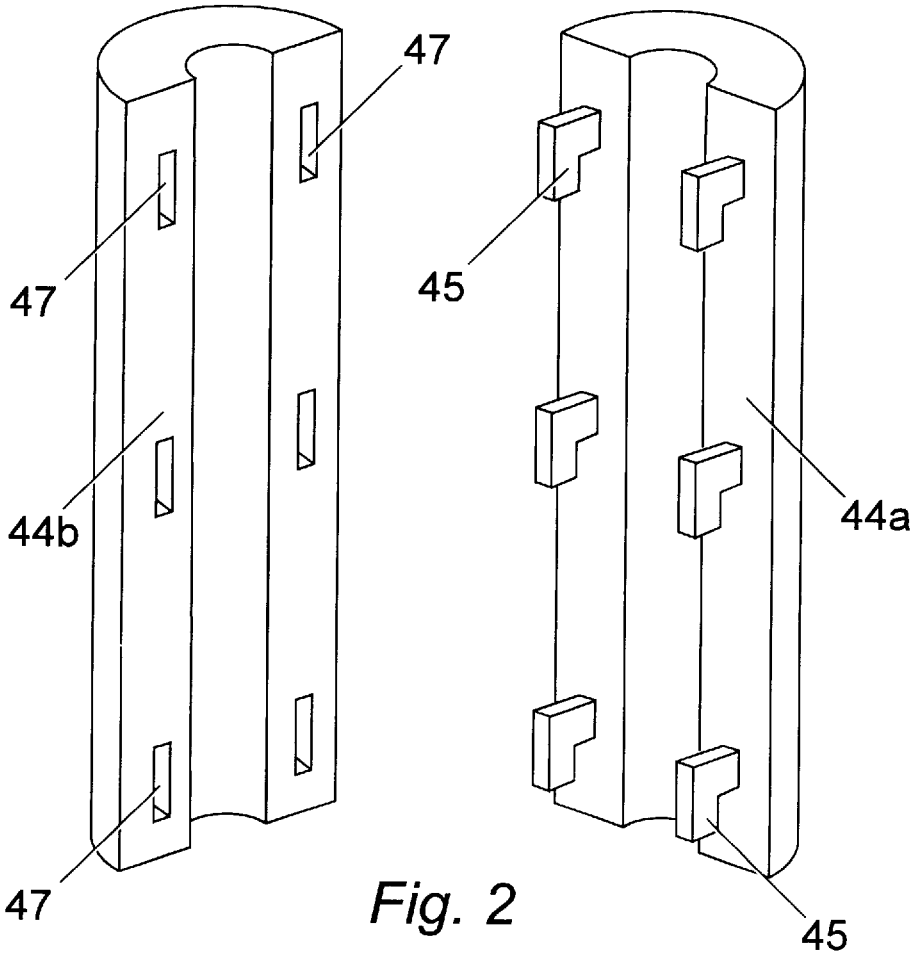
FIG. 2 is a disassembled view of a grease tube used in the apparatus of FIG. 1.
Figure 3:
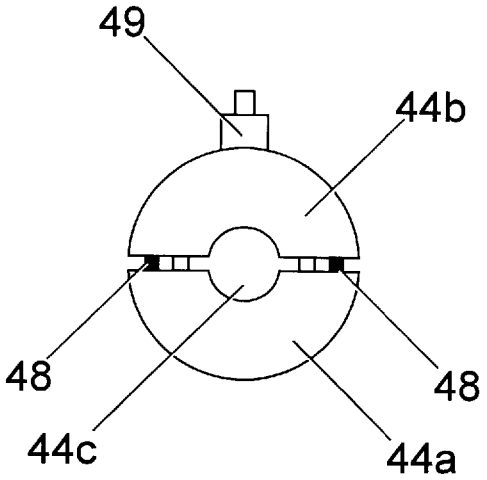
FIG. 3 is an end view of the grease tube of FIG. 2.

The upper end plate 24 mounts a wireline entry assembly generally designated at 42 and comprising a grease tube 44 and a pack-off 46. The grease tube 44 performs the same function as those used in conventional forms of wireline apparatus but is of a novel form. As seen in FIGS. 2 and 3, two semicylindrical halves 44*a* and 44*b* clamp together to define a central bore 44*c* through which the wire (not shown) passes, the central bore 44*c* being sealed by edge seals 48.

One grease tube half 44*a* is provided with hook-shaped lugs 45 which are engageable in cooperating slots 47 in the other tube half 44*b*. Preferably, the lugs and/or the slots have a sloping face such that the halves 44*a*, 44*b* are forced together with a wedging action when the halves 44*a*, 44*b* are mated. The grease tube also comprises a valve or nipple 49 through which grease may be pumped into the assembled tube 44.

Figure 2A:
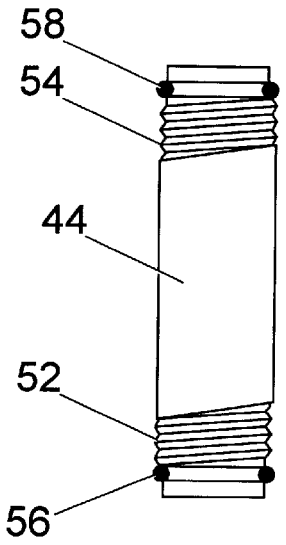
FIG. 2A is a side view of the grease tube.

The outer surface of the grease tube 44 is formed (FIG. 2A) with a lower thread 52 which is engageable in a threaded bore in the upper end plate 24, and with an upper thread 54 for mounting the pack-off 46. The outer surface of the grease tube 44 is also provided with O-ring seals 56 and 58 for sealing against the upper end plate 24 and the pack-off 46, respectively.

The pack-off 46 is of conventional form as well known in wireline apparatus. As is also conventional, two pack-offs may be used in series.

Figure 5:
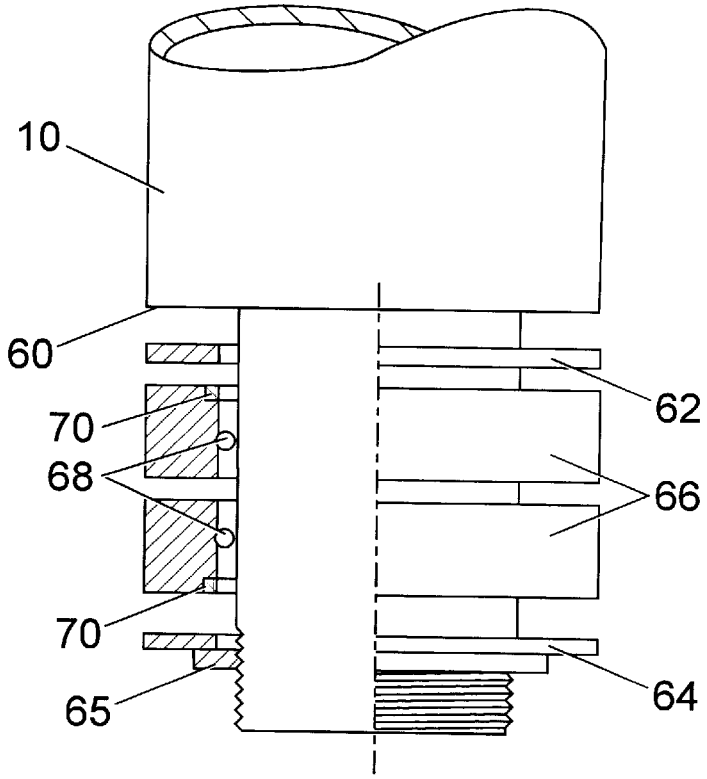
FIG. 5 is a detailed view of a bearing and seal assembly used in the apparatus of FIG. 1.

FIG. 5 shows one bearing and seal assembly 30 in greater detail. The end of the sub 10 is formed with a shoulder 60 which engages a bushing 62. The bushing 62 bears on the top surface of the end plate 24, and a second bushing 64 bears on its underside. The second bushing 64 is held in place, in use, by a screw ring 65. The bushings 62, 64 are suitably of phosphor bronze, or may be roller bearings, thrust bearings or any other suitable bearing for, the application. They may be provided in various thicknesses for use as shims to take up end float. The sub 10 is journalled in the end plate 24 by two bearing rings 66, each provided with bearing elements such as balls 68 and an annular lip seal 70.

Figure 6:
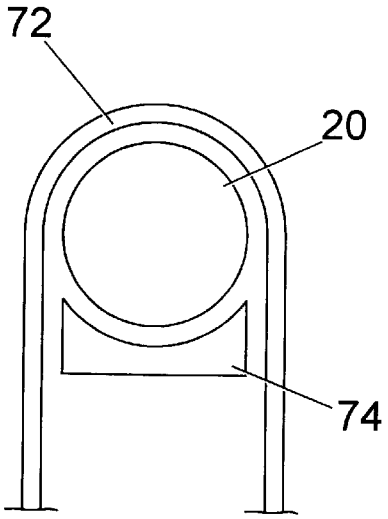
FIG. 6 is a plan view illustrating the mounting of the apparatus of FIG. 1 in a drilling rig.

As seen in FIG. 6, the outer housing 20 is engaged in use by a tie rod 72 and tie rod support 74. The tie rod 72 provides two free ends which are secured to the bail arms (not shown) forming part of a normal drilling rig.

Thus, the wireline entry tool can be placed in the drill string to allow the drill string to be rotated, moved up and down, and drilling mud pumped in the normal manner. When desired, wireline apparatus can be run through the grease tube and into the drill string bore with only shallow angles of bending being used.

In a typical example, the tool will be approximately 10 feet in length and will handle a pressure of 5,000–10,000 psi and a torque and a pull as per regular drill pipe specification.

Two particular modifications of the foregoing embodiment will now be described.

In a first modification, the wireline entry assembly 18 is provided with an entry port additional to the main flow channel and the grease tube 44. The additional entry port is suitably provided in the upper end plate 24, and may comprise a further wireline entry assembly or a valved port for the introduction of mud, cement or special fluids.

The second modification replaces the 1:1 power transmission described above with a transmission of a significantly different ratio. This transmission may comprise a gear set or may be, for example, hydraulic. In a particularly preferred from, the transmission ratio is chosen such that a high speed, low torque power source may be used to drive the drill string in a low speed. High torque mode. such a modification would be particularly useful in land-based operations in remote sites, since it would permit the use of automotive-type engines as the power source rather than a conventional top drive arrangement, which could save as much as 100,000 pounds in weight.

It would be possible to use a number of such units in series to give a desired torque multiplication.

Figure 8:
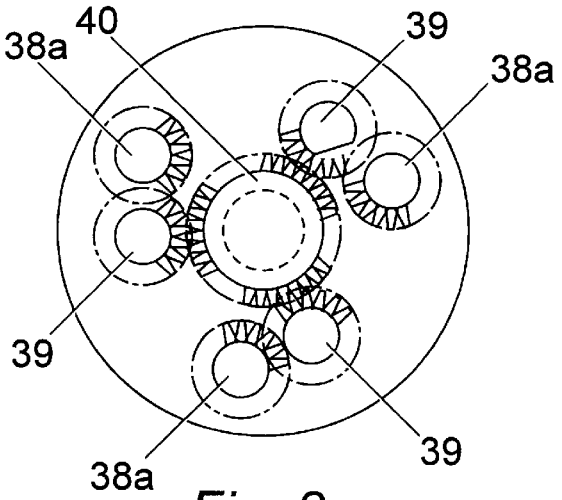
FIG. 8 is an underneath plan view of part of the cog system in the tool of FIG. 7.
Figure 7:
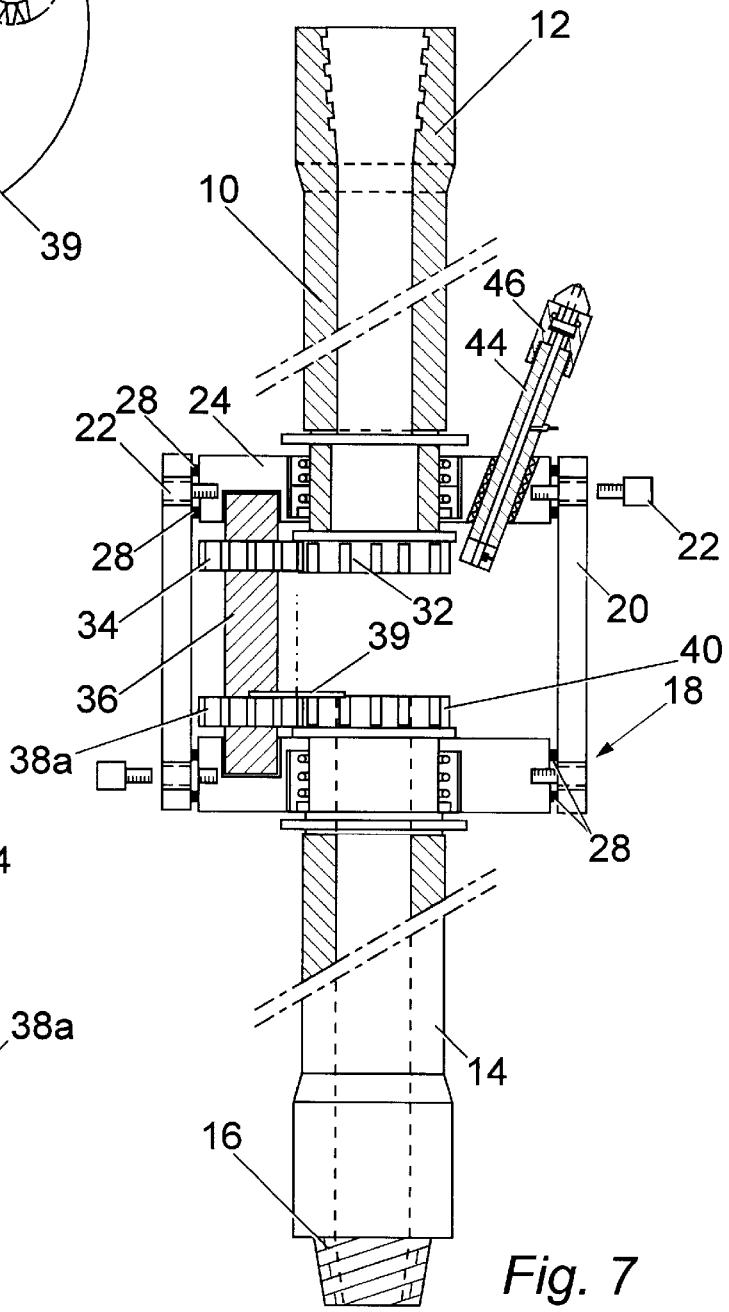
FIG. 7 is a view similar to that of FIG. 1 but showing an alternative embodiment of the entry tool of the present invention.
Figure 9:
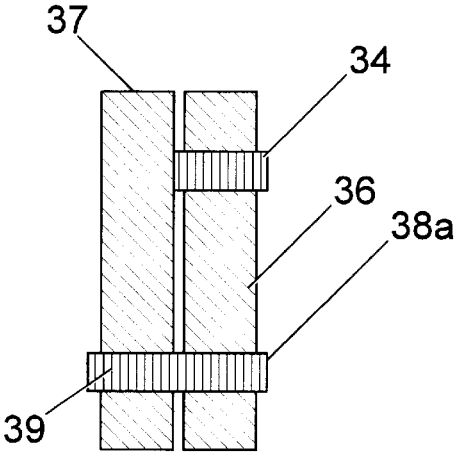
FIG. 9 is a side view of a pair of layshafts used in the arrangement of FIGS. 7 and 8.

FIGS. 7 to 9 show a modified embodiment. Parts which are similar to those of the first embodiment are denoted by like references.

In this embodiment, the upper sub 10 drives three layshafts 36 via upper cogs 32 and 34, as in FIG. 1. The lower ends of the layshafts 36, however, are provided with cogs 38*a* of a diameter slightly less than that of the cogs 34. The cogs 38*a* drive the cog 40 on the lower sub 14 via three intermediate cogs 39 each carried by a respective intermediate layshaft 37. In this manner, the lower sub 14 is driven in a direction opposite to that of the upper sub 10.

Figure 10:
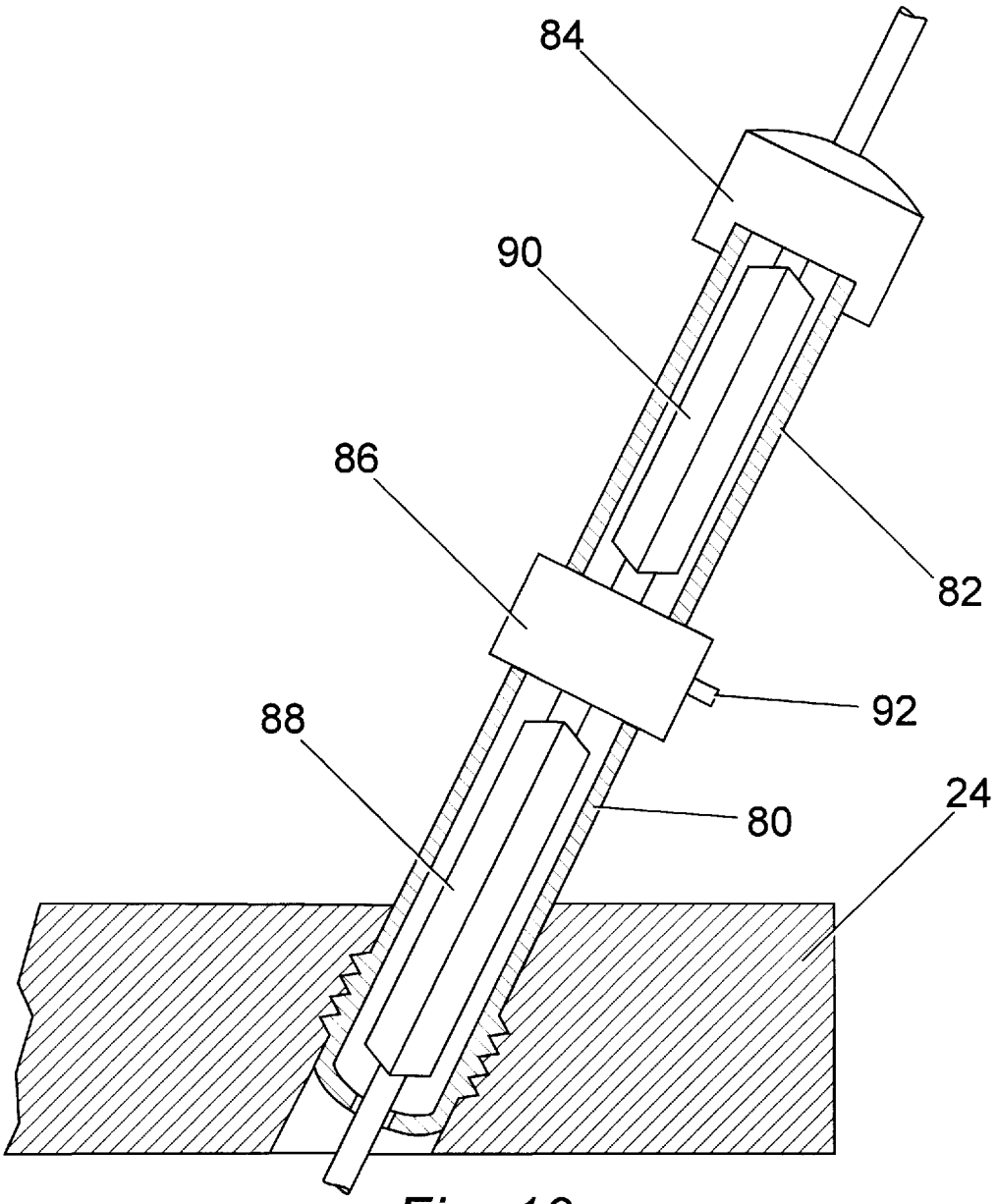
FIG. 10 is a sectional side view of a modified grease tube which may be used in the embodiments of FIGS. 1 and 7.

FIG. 10 illustrates a modified form of grease tube assembly. An outer tubular member is formed by a lower tube 80 threaded into the upper end plate and an upper tube 82 the upper end of which is provided with a stuffing box 84. The upper and lower tubes 82, 80 are interconnected by a collar 86. At least the lower tube is of sufficient internal diameter to allow a wireline instrument package to be passed through it.

The outer tubular member 80–86 contains lower and upper grease tubes 88, 90 each of which is a split tube assembly similar to that of FIGS. 1–3 and which can thus be assembled around the wireline after the instrument package has been inserted in to the string.

The collar 86 is provided with a nipple or entry port indicated at 92 for grease injection.

The provision of an outer tubular member gives additional strength and a back-up safety feature which is beneficial when using a wireline simultaneously with pumping mud under pressure.

Other modifications and improvements may be made within the scope of the invention.

I claim:

1. A well entry tool comprises an upper tubular member and a lower tubular member connected together by an intermediate assembly; the upper and lower tubular members being provided with outer end portions for connection of the tool in a drill string for fluid flow therethrough; the intermediate assembly comprising a hollow body including axially aligned, spaced bearing devices receiving the upper and lower tubular members to provide rotation of the tubular members relative to the hollow body, a power transmission mechanism within the hollow body for transmitting torque from the upper tubular member to the lower tubular member, and an entry device allowing a flexible elongate member to pass sealingly from the exterior to the interior of the hollow body.

2. A well entry tool according to claim 1, wherein the power transmission mechanism comprises respective annular cogs secured to inner ends of the tubular members located within the hollow body, the respective annular cogs being interconnected by means of meshing cogs mounted on at least one primary layshaft.

3. A well entry tool according to claim 2, wherein two or more primary layshafts are provided.

4. A well entry tool according to claim 3, wherein three primary layshafts are provided.

5. A well entry tool according to claim 3, wherein the primary layshafts are equispaced circumferentially within the hollow body.

6. A well entry tool according to 2, wherein a respective intermediate layshaft is associated with each primary layshaft, the intermediate layshafts providing an additional cog which intercouples one of the respective annular cogs to respective meshing cogs, whereby the upper and lower tubular members rotate in opposite directions.

7. A well entry tool according to claim 2, wherein the hollow body comprises a tubular outer housing and a pair of end plates, and the inner ends of the tubular members are mounted on the end plates.

8. A well entry tool according to claim 7, wherein the at least one primary layshaft is rotatably mounted on the end plates.

9. A well entry tool according to claim 7, wherein the entry means comprises a passage through the hollow body aligned at a shallow angle to the axial bore of the lower tubular member.

10. A well entry tool according to claim 9, wherein the passage is provided by a grease tube secured to an angled bore in the hollow body.

11. A well entry tool according to claim 10, wherein the angled bore is provided in the upper end plate.

12. A wireline entry tool according to claim 1 for permitting a wireline to pass sealingly from the exterior to the interior of the hollow body.

13. A wireline entry tool according to claim 1, wherein the entry means comprises a grease tube for sealing against a wireline entering a borehole, the borehole having a central bore, the grease tube comprising two longitudinal halves releasably secured together to define a passage for passing of the wireline through the bore of the borehole.

14. A grease tube for sealing against a wireline entering a borehole, the borehole having a central bore, the grease tube comprising two longitudinal halves reasonably secured together by inter-engageable lugs and slots to define a passage for passing of the wireline through the bore of the borehole.

15. A grease tube according to claim 14, wherein the two longitudinal tube halves are each hemi-cylindrical.

16. A grease tube according to claim 14, wherein the lugs and slots interact when engaged to exert a wedging force to releasably secure the tube halves together.

17. A grease tube according to claim 14, wherein the tube halves are provided with external formations which, when the tube halves are secured together, form a securing formation for securing the grease tube to a wireline entry tool.

* * * * *

UNITED STATES PATENT AND TRADEMARK OFFICE

CERTIFICATE OF CORRECTION

PATENT NO. : 5,803,191
DATED : September 8, 1998
INVENTOR(S) : Mackintosh

It is certified that error appears in the above-identified patent and that said Letters Patent is hereby corrected as shown below:

Column 6,
Line 9, should read: comprising two longitudinal ~~reasonably~~ releasably secured Signed and Sealed this Twenty-third Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,803,191
DATED : September 8, 1998
INVENTOR(S) : Mackintosh

It is certified that error appears in the above-identified patent and that said Letters Patent is hereby corrected as shown below:

Column 6,
Line 9, should read -- comprising two longitudinal halves releasably secured --

Signed and Sealed this

Thirtieth Day of April, 2002

*Attest:*

*Attesting Officer*

JAMES E. ROGAN
*Director of the United States Patent and Trademark Office*